US011034168B2

(12) United States Patent
Rubio et al.

(10) Patent No.: US 11,034,168 B2
(45) Date of Patent: Jun. 15, 2021

(54) PRINTING WITHIN DEFINED ZONES

(71) Applicant: Hewlett-Packard Development Company, L.P., Spring, TX (US)

(72) Inventors: Leticia Rubio, Barcelona (ES); Utpal Sarkar, Barcelona (ES); Raul Rodriguez Alonso, Barcelona (ES); Xavier Quintero Ruiz, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/475,609

(22) PCT Filed: Apr. 21, 2017

(86) PCT No.: PCT/US2017/028933
§ 371 (c)(1),
(2) Date: Jul. 2, 2019

(87) PCT Pub. No.: WO2018/194675
PCT Pub. Date: Oct. 25, 2018

(65) Prior Publication Data

US 2019/0322109 A1 Oct. 24, 2019

(51) Int. Cl.
*B41J 11/00* (2006.01)

(52) U.S. Cl.
CPC ..... *B41J 11/0065* (2013.01); *B41J 11/008* (2013.01)

(58) Field of Classification Search
CPC ..... B41J 11/0065; B41J 11/008
See application file for complete search history.

(56) References Cited

U.S. PATENT DOCUMENTS

| | | | |
|---|---|---|---|
| 5,028,514 | A | 7/1991 | Johannsen |
| 6,280,023 | B1 | 8/2001 | Ufkes |
| 6,454,389 | B1 | 9/2002 | Couwenhoven |
| 6,871,934 | B2 | 3/2005 | Masuyama et al. |
| 7,387,361 | B1 | 6/2008 | Rueby et al. |

(Continued)

FOREIGN PATENT DOCUMENTS

| | | |
|---|---|---|
| CN | 1066398 C | 5/2001 |
| CN | 1081988 C | 4/2002 |

(Continued)

OTHER PUBLICATIONS

Execute Borderless Printing, <http://ugp01.c-ij.com/ij/webmanual/PrinterDriver/W/MX450%20series/1.0/EN/PPG/Dg-c___borderless.html>.

*Primary Examiner* — Jason S Uhlenhake
(74) *Attorney, Agent, or Firm* — HP Inc. Patent Department

(57) ABSTRACT

A method of printing on a printable medium is disclosed. The method of printing may use a print head having a plurality of nozzles. The printable medium may have a leading edge and a defined zone adjacent to the leading edge. The print head may deposit print agent onto the printable medium via the plurality of nozzles during successive printing passes. The method may comprise printing outside, and not within, the defined zone on the printable medium using a first subset of nozzles of the plurality of nozzles. The method may further comprise printing within, and not outside, the defined zone on the printable medium using a second subset of nozzles of the plurality of nozzles.

12 Claims, 12 Drawing Sheets

(56) References Cited

U.S. PATENT DOCUMENTS

| | | | | |
|---|---|---|---|---|
| 7,648,216 | B2 | 1/2010 | See Toh et al. | |
| 8,789,907 | B2 | 7/2014 | Vall et al. | |
| 9,359,160 | B2 | 6/2016 | Yoshida et al. | |
| 9,387,686 | B2 | 7/2016 | Yoshida | |
| 2002/0047885 | A1 | 4/2002 | Miyawaki et al. | |
| 2004/0212658 | A1 | 10/2004 | Otsuki | |
| 2005/0078139 | A1 | 4/2005 | Kang et al. | |
| 2005/0206701 | A1* | 9/2005 | Komatsu | B41J 11/057 347/96 |
| 2006/0050107 | A1 | 3/2006 | Yamanaka et al. | |
| 2006/0209114 | A1* | 9/2006 | Namai | B41J 29/393 347/16 |
| 2007/0273899 | A1 | 11/2007 | Yazawa | |
| 2008/0055352 | A1 | 3/2008 | Toh et al. | |
| 2008/0266343 | A1 | 10/2008 | Borrell et al. | |
| 2009/0033694 | A1 | 2/2009 | Shi et al. | |
| 2014/0152727 | A1 | 6/2014 | Vall et al. | |

FOREIGN PATENT DOCUMENTS

| | | | |
|---|---|---|---|
| CN | 100553987 | C | 10/2009 |
| EP | 1228876 | | 8/2002 |
| EP | 1251009 | A1 | 10/2002 |
| EP | 1285767 | | 2/2003 |
| JP | 2002103586 | | 4/2002 |
| JP | 2003127341 | | 5/2003 |
| JP | 2005271231 | | 10/2005 |
| JP | 2006231930 | A | 9/2006 |
| RU | 2096183 | C1 | 11/1997 |
| WO | WO-2007061138 | | 5/2007 |

* cited by examiner

PRINTING WITHIN DEFINED ZONES

BACKGROUND

A print apparatus may be used to deliver print agent, such as ink, in a pattern onto a substrate, such as a sheet of paper.

A print apparatus may be used to print anywhere on the substrate, including up to the edges of the substrate. It may be intended that print agent is delivered up to, but not beyond an edge of the substrate.

BRIEF DESCRIPTION OF DRAWINGS

Examples will now be described, by way of non-limiting example, with reference to the accompanying drawings, in which.

DETAILED DESCRIPTION

Figure 1A:
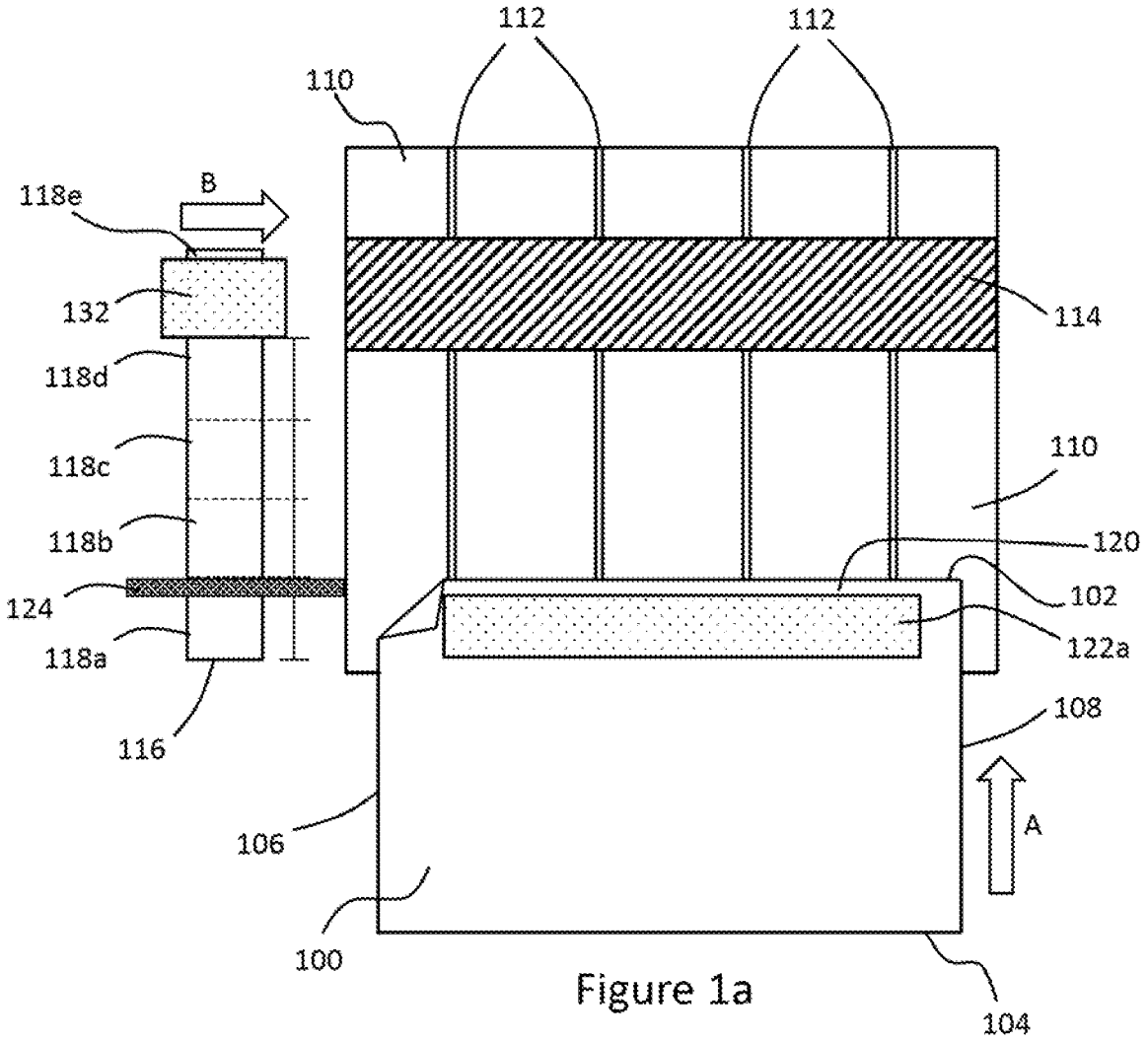
FIG. 1 is a series of schematics showing an example of eight stages of a print job.

A printing apparatus may be used to deliver print agent, such as ink, onto a substrate, such as a sheet of paper as the substrate is moved over a platen. Print agent may be contained in a reservoir. For example, print agent may be held in tanks or cartridges. Print agent may be delivered by a nozzle of a print agent distributor, or print head. For example, print heads fluidly connected to ink tanks may deliver ink from the ink tanks to the print head and deposit ink via nozzles of the print heads onto the substrate in a pattern according to print job data processed, for example by processing apparatus.

A print job may, in some examples, involve the delivery of print agent within a defined zone adjacent to an edge of the substrate and, in some example, up to (or substantially to) the edge of the substrate. Printing in this way may be referred to as borderless printing or full bleed printing. When printing at full bleed, the print head may, intentionally or otherwise, deliver print agent to area just beyond the edge of the substrate onto a surface supporting the substrate, for example the platen. Print agent delivered onto the platen may transfer onto the substrate as the substrate is moved over the platen, thereby damaging the substrate. The platen may, therefore, be provided or supplemented with a portion, for example a print agent-absorbent portion, onto which print agent may be delivered without the risk (or with a lower risk) that the print agent is then transferred back onto the substrate inadvertently.

FIG. 1 is a schematic showing an example of eight stages of a print job using a print apparatus. In FIGS. 1*a* to 1*h*, a portion of a print apparatus is shown.

A print apparatus may be used to print (e.g. deliver print agent) onto a substrate 100. The substrate 100 may be any type of printable medium (also called a print medium), and may be a sheet of material, such as paper, capable of receiving print agent. In other examples, the substrate 100 may be a sheet of cardboard, wood, glass, metal or plastics material. The substrate 100 may be any shape. In the example described herein the substrate 100 is substantially rectangular having a leading edge 102, a trailing edge 104, a first side edge 106 and a second side edge 108. In some examples, the substrate 100 may take the form of individual sheets while, in other examples, the substrate may include a roll of material, such as a web substrate, to be printed and cut to a desired length.

The print apparatus includes a print bed which may include a platen 110, which may be a flat surface to support the substrate 100 during the printing process. The substrate 100 may be moved, or advanced, over the platen 110 using a substrate advancer, or advancing system (not shown in FIG. 1), which may include a roller and/or a wheel. In the example shown in FIG. 1, the direction of movement of the substrate 100 over the platen 110 is shown by arrow A. The platen 110 may, in some examples, include a rib 112 extending at least partially over the platen in the direction of movement of the substrate 100, shown by the arrow A. In some examples, the platen 110 may include multiple ribs 112. In the example shown in FIG. 1, the platen 110 includes four ribs 112, but in other examples, more or fewer ribs may be provided. The ribs 112 may extend proud of the platen 110 (that is to say, the ribs may extend slightly upwards from the platen) such that the form a series of ridges. The ribs 112 are provided to support the substrate 100 as the substrate advances over the platen 110.

As noted above, in some examples, the platen 110 may include a portion 114 formed from a print agent-absorbent (e.g. ink-absorbent) material, such as foam. The absorbent portion 114 may have a width equal to a width of the platen 110, such that the absorbent material extends over the width of the platen as shown in the example of FIG. 1. In other examples, the absorbent portion 114 may have a width less than the width of the platen, but the width of the absorbent portion may be greater than a width of the substrate 100 to be printed. In some examples, the absorbent portion 114 may form a part of the platen 110 while, in other examples, the platen may comprise two separate portions separated by the absorbent portion. As can be seen, in the example of FIG. 1, the ribs 112 extend over the platen 110 but not over the absorbent portion 114. In other examples, however, the ribs 112 may extend at least partially over the absorbent portion 114.

The print apparatus further includes a print agent distributor, or print head 116, having a plurality of nozzles (not shown) via which print agent may be delivered onto the substrate. As used herein, "delivering" print agent includes firing, ejecting or otherwise depositing print agent or print fluid. The selection of the nozzles via which print agent is to be delivered is made by a control unit, or processing apparatus (not shown), and is made based on the pattern to be printed. In some examples, a printing mask may be used to define which nozzles are to print and which are not to print. The nozzles are, in some examples, arranged in an array, and may be arranged in rows (i.e. parallel to the leading edge 102 of the substrate 100 in FIG. 1) and columns (i.e. parallel to the side edges 106, 108 in FIG. 1). During printing, the print head 116 moves over the platen 110 and the substrate 100 in a direction perpendicular to the direction of movement of the substrate, in a printing pass, in the direction of arrow B in FIG. 1.

The array of nozzles in the print head 116 may be arranged in subgroups. For example, the nozzles of the print head 116 may be arranged in five subgroups or bands, as shown in FIG. 1. In the example shown in FIG. 1, a first band 118*a* of nozzles is located at a first position in the print head, a second band 118*b* of nozzles is located at a second position in the print head, a third band 118*c* of nozzles is located at a third position in the print head, a fourth band 118*d* of nozzles is located at a fourth position in the print head and a fifth band 118*e* of nozzles is located at a fifth position in the print head. Each band of nozzles may be controlled to deliver print agent independently of the others, or two or more of the bands of nozzles may be controlled to deliver print agent simultaneously. In some examples, some nozzles within a particular band of nozzles may deliver print agent while other nozzles in the particular band of nozzles may be prevented from delivering print agent.

The maximum area (for example on a substrate) that can be printed by the print head 116 in a single pass may be called a swath. In this context, the number of rows (which may be measured in rows of nozzles or rows of a resulting pattern/image, for example pixel rows) that may be printed may be referred to as a "swath height". The expressions "pass" or "print pass" are intended to mean a movement of the print head 116 over the substrate during which print agent is deposited. In some examples, print agent may be delivered when the print head 116 moves in the direction B (i.e. from left to right in FIG. 1). After the pass, the print head 116 may return to its starting position (i.e. its position in FIG. 1) before performing a second pass. In other examples, print agent may also be deposited while the print head 116 moves in the direction opposite to the arrow B (i.e. from right to left in FIG. 1). In such an example, each time the print head travels completely over the substrate may be a print pass.

In some examples, the print head 116 may be such that the area to be printed by all of the nozzles, or by all of the bands of nozzles, is completed after multiple passes of the print head. In other words, the swath is completed after multiple passes of the print head 116 over the substrate 100. By using such a so-called "multi-pass" print mode, the resulting print quality may be higher than can be achieved using a single-pass print mode, as a greater amount of print agent may be delivered to the substrate 100. Further, the print agent may be able to dry between each pass of the print head 116, meaning the interaction between fresh print agent delivered during each pass pf the print head with print agent already delivered to the substrate is different to the interaction between print agent and the substrate if the print agent is delivered during a single pass.

FIGS. 1*a* to 1*h* show various stages of a multi-pass print job as the substrate 100 is advanced over the platen 110 according to an example. Print agent may, in some examples, be delivered onto the substrate by a different band of nozzles during each pass. In the example shown, print agent is to be delivered (printed) onto the substrate 100 up to the leading edge 102. In this example, a defined zone 120 is defined adjacent to the leading edge 102 of the substrate 100, the defined zone defining an area within which print agent is not to be delivered while the leading edge of the substrate 100 is over the platen 110, as s discussed below. The defined zone 120 may be a zone of any shape. In some examples described herein, the defined zone includes an edge of the substrate. The defined zone 120, in some examples, may be considered to be a margin. The margin 120 serves as a boundary beyond which print agent may be printed onto the substrate 100 if the leading edge 102 is over a defined area (such as the absorbent portion 114) of the platen 110.

FIG. 1*a* shows the position of the substrate 100 after completion of a first pass of the print head 116. Prior to the first pass, the substrate 100 may be moved into position by the substrate advancer or advancing system (not shown). During the first pass, print agent may be delivered via nozzles in the first band 118*a* of nozzles to form a pattern 122*a* on the substrate 110. Depending on the print job data, the pattern printed may include, amongst other things, text, a drawing, a shape and/or a photograph, and may be in black and white (monochrome) or colour. As is shown in FIG. 1*a*, even though the substrate 100 is positioned such that all of the nozzles in the first band 118*a* of nozzles pass over the substrate during the first pass of the print head, a nozzle (or in some examples, a row of nozzles) may not deliver print agent during the first pass. Specifically, a nozzle within a region 124 may not be fired, or may be prevented from delivering print agent onto the substrate 100, as those nozzles are aligned with (i.e. fall within) the margin 120 during the first pass. Thus, during the first pass, nozzles in the first band 118*a* that are not within the region 124 may deliver print agent onto the substrate 100 outside the margin 120, and nozzles within the region 124 in the first band of nozzles are instructed not to deliver print agent, or are otherwise prevented from delivering print agent onto the substrate within the margin. In this way, in the example shown, the pattern 122*a* formed on the substrate from the first pass of the print head 116 has a smaller width than would be possible if the first band 118*a* of nozzles were to fire during a pass over a portion of the substrate that did not include the margin 120.

The way in which a nozzle, or a rows of nozzles, of the print head may be prevented from delivering print agent may be achieved in various ways. In some examples, each row of nozzles may be independently instructed by the processing apparatus in accordance with the print job data. In other words, a particular row of nozzles may be instructed to print or not print, based on whether the particular row of nozzles is aligned with the margin 120 of the substrate 100. In other examples, a print mask may be generated and applied to the nozzles of the print head 116. The print mask may be a virtual mask (e.g. a mask defined in computer code) and may comprise a binary code for each nozzle in the print head. In some examples, the print mask may include, for each nozzle, a ONE (1) which corresponds to an instruction for a nozzle to deliver print agent, or a ZERO (0) which corresponds to an instruction for the nozzle not to deliver print agent. As such, the print mask may, in some examples comprise an array of ones and zeroes, each digit defining an instruction for a corresponding nozzle. The print mask may be generated and/or applied by processing apparatus, such as processing apparatus associated with, or within, the print apparatus. The print mask may be based on the size of the margin 120 defined for the substrate 100. For example, if a margin for a particular substrate is defined as being 1 mm (i.e. a strip along the leading edge 102 of the substrate 100 having a width of 1 mm), then the processing apparatus may determine that forty rows of nozzles would fire within the margin during a printing pass and, therefore, each nozzle in those forty rows (i.e. the rows of nozzles within the region 124) are masked and instructed not to fire during the first pass.

In the example of FIG. 1, the second, third, fourth and fifth bands 118*b*, 118*c*, 118*d*, 118*e* of nozzles of the print head 116 do not pass over the substrate during the first pass and, therefore, nozzles within the second, third, fourth and fifth bands may be instructed not to fire during the first pass. Accordingly, the print mask may include a 'zero', or a 'do not fire' instruction for each nozzle in the second, third, fourth and fifth bands during the first pass.

Once the first pass has been completed, and the pattern 122*a* has been printed, the substrate 100 is advanced by a defined distance. In this example, the substrate 100 is advanced in the direction of the arrow A by a distance defined by the number of bands of nozzles in the print head 116. For example, in the case shown in FIG. 1, the substrate 100 is advanced by a distance equivalent to the length of a band of nozzles (i.e. by a distance equivalent to the number of rows of nozzles in a single band of nozzles).

Figure 1B:
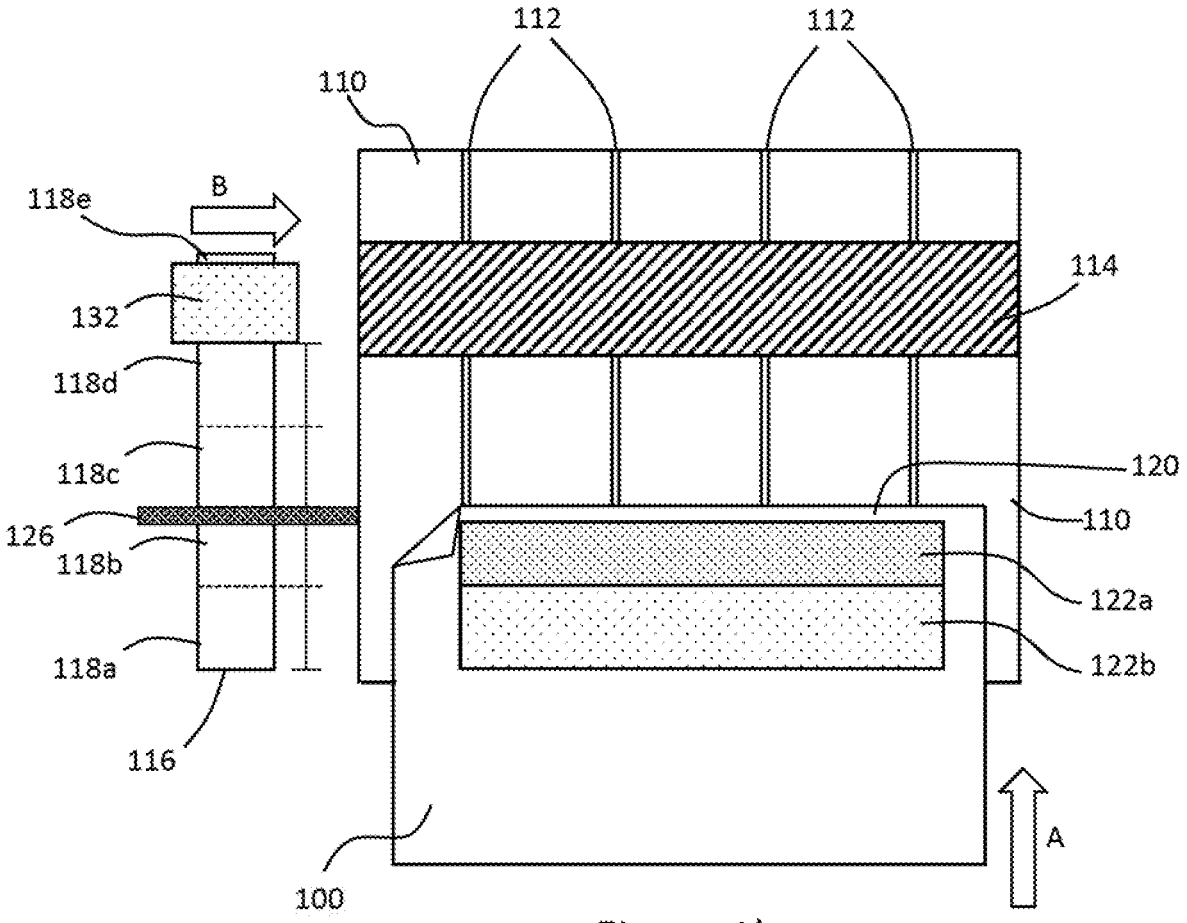

FIG. 1*b* shows the position of the substrate 100 after the substrate has been advanced (following the first pass) and after a second pass of the print head 116. After the substrate has advanced, the pattern 122*a* may be aligned with the second band 118*b* of nozzles in the print head 116, and the first band 118*a* of nozzles may be aligned with a portion of the substrate adjacent to the pattern 122*a*. During the second pass of the print head 116 over the substrate 100, all of the nozzles in the first band 118*a* may be instructed or allowed to fire as none of the rows of nozzles in the first band are aligned with the margin 120 after the substrate has advanced. However, after the substrate has advanced following the first pass, the margin 120 of the substrate 100 is aligned with a nozzle (or a row of nozzles) in the second band 118*b*. Therefore, a processing apparatus associated with the print apparatus and/or the print head may generate and/or apply a print mask in which nozzles (e.g. a row of nozzles) within the region 124 (see FIG. 1*a*) are instructed or allowed to fire during the second print pass, but nozzles (e.g. a row of nozzles), which are within a region 126, and therefore are aligned with the margin 120, are not fired or are instructed not to fire during the second print pass. The print mask generated for the second print pass may allow those nozzles or rows of nozzles in the second band 118*b* which are not within the region 126 to fire during the second print pass, along with the nozzles within the first band 118*a*. As in the first print pass, the nozzles within third, fourth and fifth bands 118*c*, 118*d*, 118*e* may be prevented from firing/Instructed not to fire during the second print pass as those nozzles do not pass over the substrate during the second pass.

During the second pass, those nozzles in the second band 118*b* that are enabled to print (e.g. are not masked by the print mask) may deliver print agent onto the substrate 100 in the same location as the pattern 122*a*. The nozzles in the first band 118*a* may deliver print agent onto the substrate 100 in a pattern 122*b*.

Following the second pass of the print head 116, the substrate 100 may be advanced by a defined distance (which may be the same distance by which the substrate is defined following the first print pass) by the substrate advancer or other advancing system.

Figure 1C:
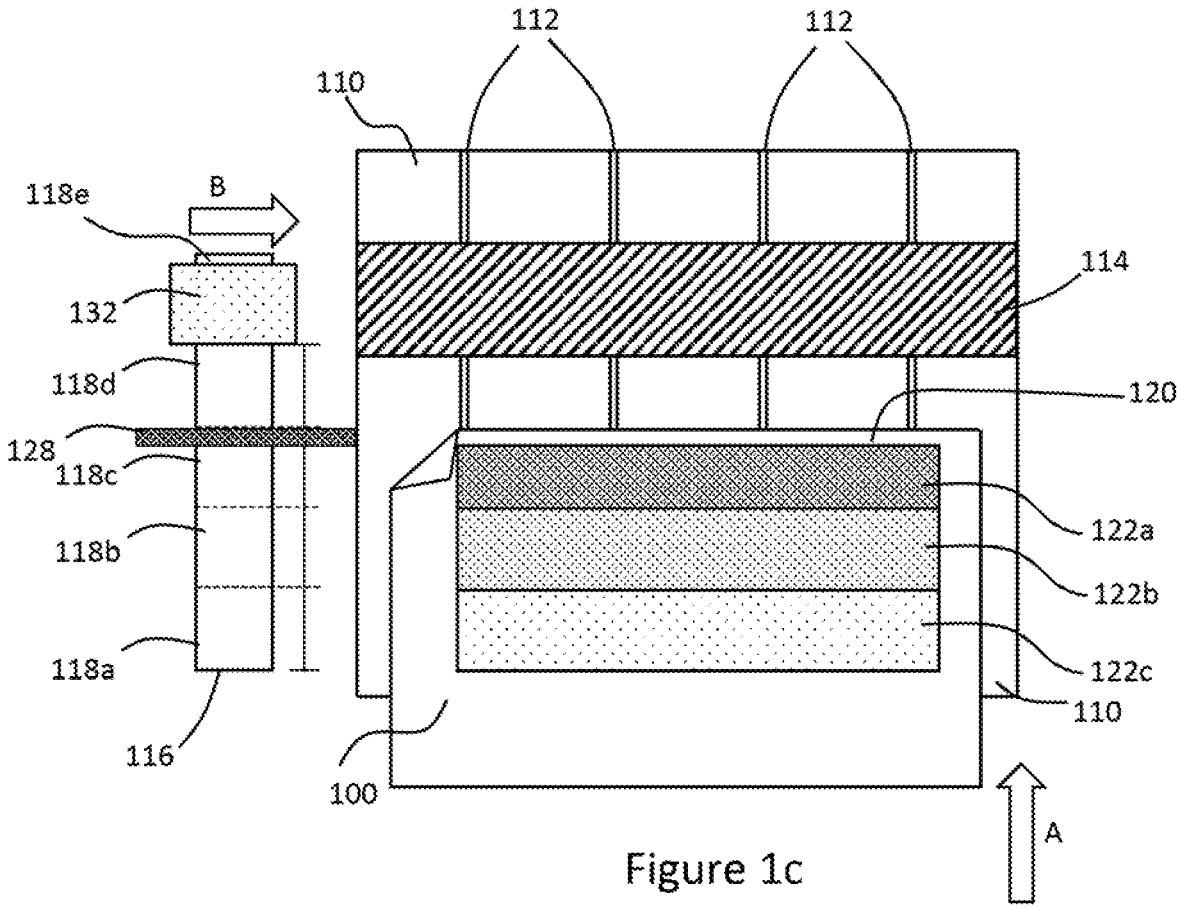

FIG. 1*c* shows the position of the substrate 100 after the substrate has been advanced (following the second pass) and after a third pass of the print head 116. During the third print pass, nozzles in the third band 118*c* of nozzles deliver print agent onto the substrate 100 in the pattern 122*a*, and those nozzles of the third band within a region 128, which are aligned with the margin 120, are masked so that they do not deliver print agent during the third pass. During the third pass, nozzles in the first band 118*a* may deliver print agent onto the substrate 100 in a pattern 122*c*.

Figure 1D:
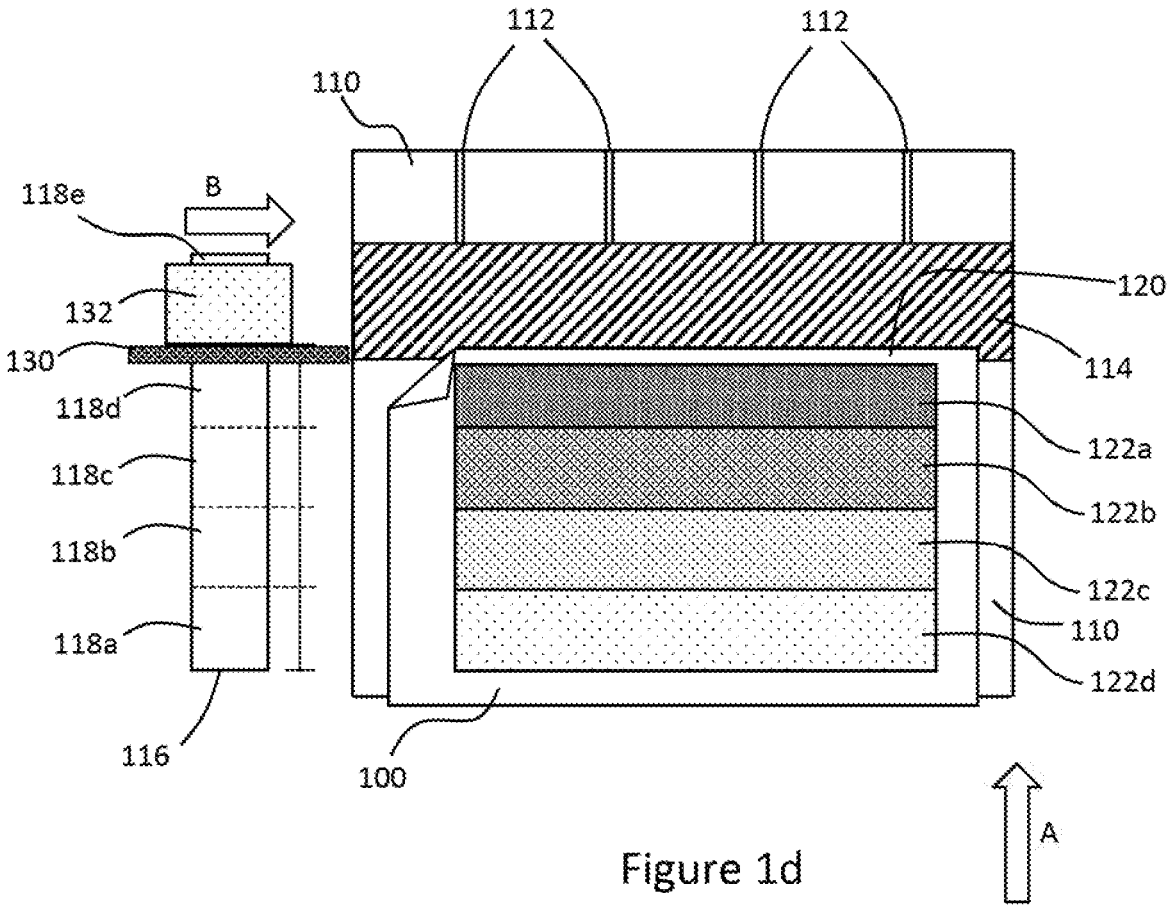

FIG. 1*d* shows the position of the substrate 100 after the substrate has been advanced (following the third pass) and after a fourth pass of the print head 116. Nozzles in the fourth band 118*d* of nozzles deliver print agent onto the substrate 100 in the pattern 122*a*, and those nozzles of the fourth band within a region 130, which are aligned with the margin 120, are masked so that they do not deliver print agent during the fourth pass. During the fourth pass, nozzles in the first band 118*a* may deliver print agent onto the substrate 100 in a pattern 122*d*.

Figure 1E:
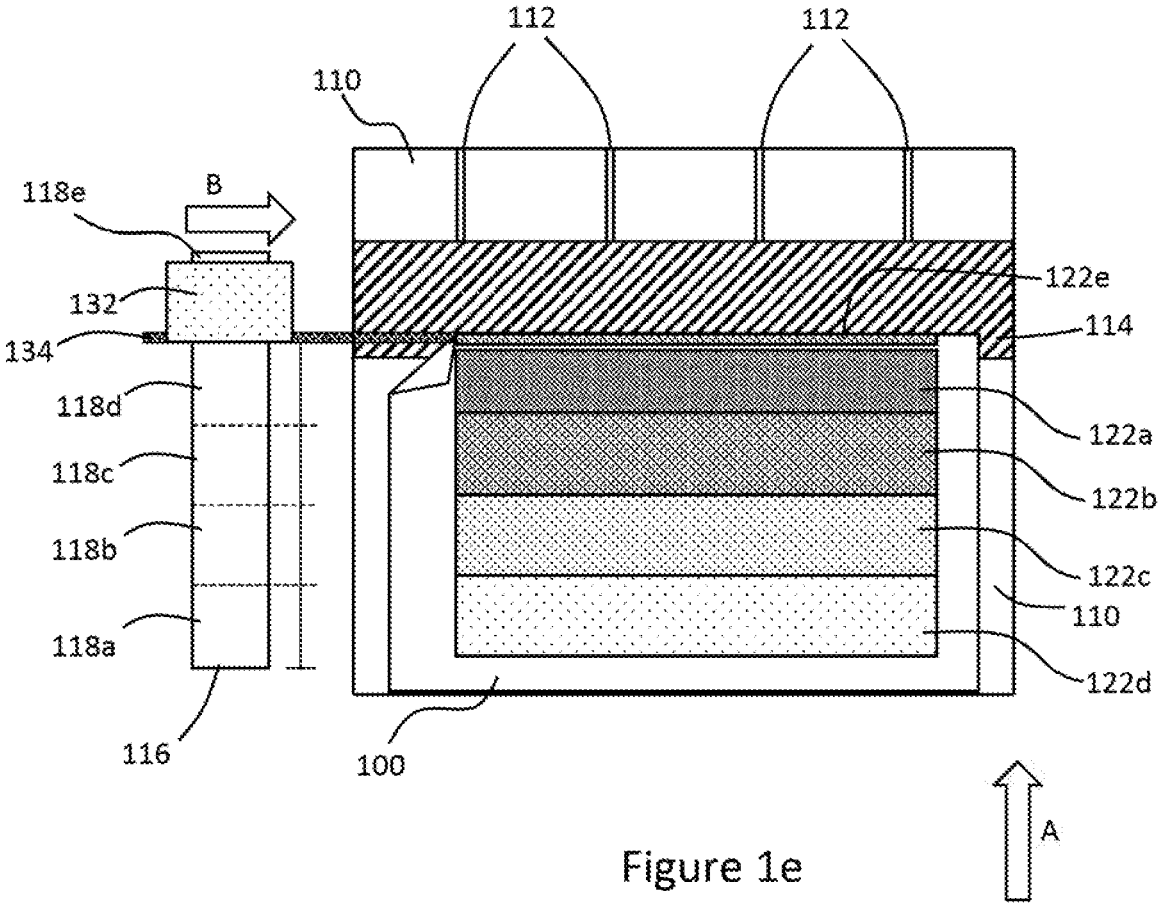

By the fourth pass of the print head 116, the substrate 100 has been advanced by such a distance that the leading edge 102 of the substrate is over the absorbent portion 114 of the platen 110. Thus, the margin 120 may be printed without the risk that print agent may be inadvertently delivered onto the platen 110. FIG. 1*e* shows the position of the substrate 100 after the substrate has been advanced (following the fourth pass) and after a fifth pass of the print head 116. Once the leading edge 102 of the substrate is over the absorbent portion 114, print agent may be delivered onto the substrate in the margin 120 by a subset of nozzles of the print head which have not delivered print agent during the first, second, third or fourth passes. In this example, a subset 132 of nozzles may be used to deliver print agent within the defined zone 120 (i.e. within the margin). In some examples, when a borderless print job is to be performed, the subset 132 of nozzles may be used just for printing within the margin 120, and not used for printing outside the margin. In some examples, if a print job is to be performed in which print agent is not to be delivered to within a margin (i.e. if the print job is not a borderless print job), then nozzles in the subset 132 may be used to deliver print agent to other areas of the substrate.

In the example shown in FIG. 1, the subset 132 of nozzles form part of the fifth band 118*e* of nozzles. It will be apparent also that, in some example, not all of the nozzles in the subset 132 of nozzles are to deliver print agent onto the substrate within the defined zone. The number of nozzles (or rows of nozzles) to be used to print within the margin may depend on the size of the margin to be printed and/or the number of print passes to be performed when printing the margin.

During the fifth pass of the print head 116, nozzles within the subset 132 of nozzles may deliver print agent into part of the margin 120. In the example shown in FIG. 1*e*, half of the margin 120 is printed during the fifth pass. Thus, nozzles in a region 134 within the subset 132 may be used to print a pattern 122*e* on the substrate. The pattern 122*e* is a strip which is, in this example, thinner than the pattern 122*a* printed during previous passes. Thus, the distance by which the substrate is advanced prior to the fifth pass may be shorter than the distance by which the substrate is advanced between the first, second, third and fourth passes.

Figure 1F:
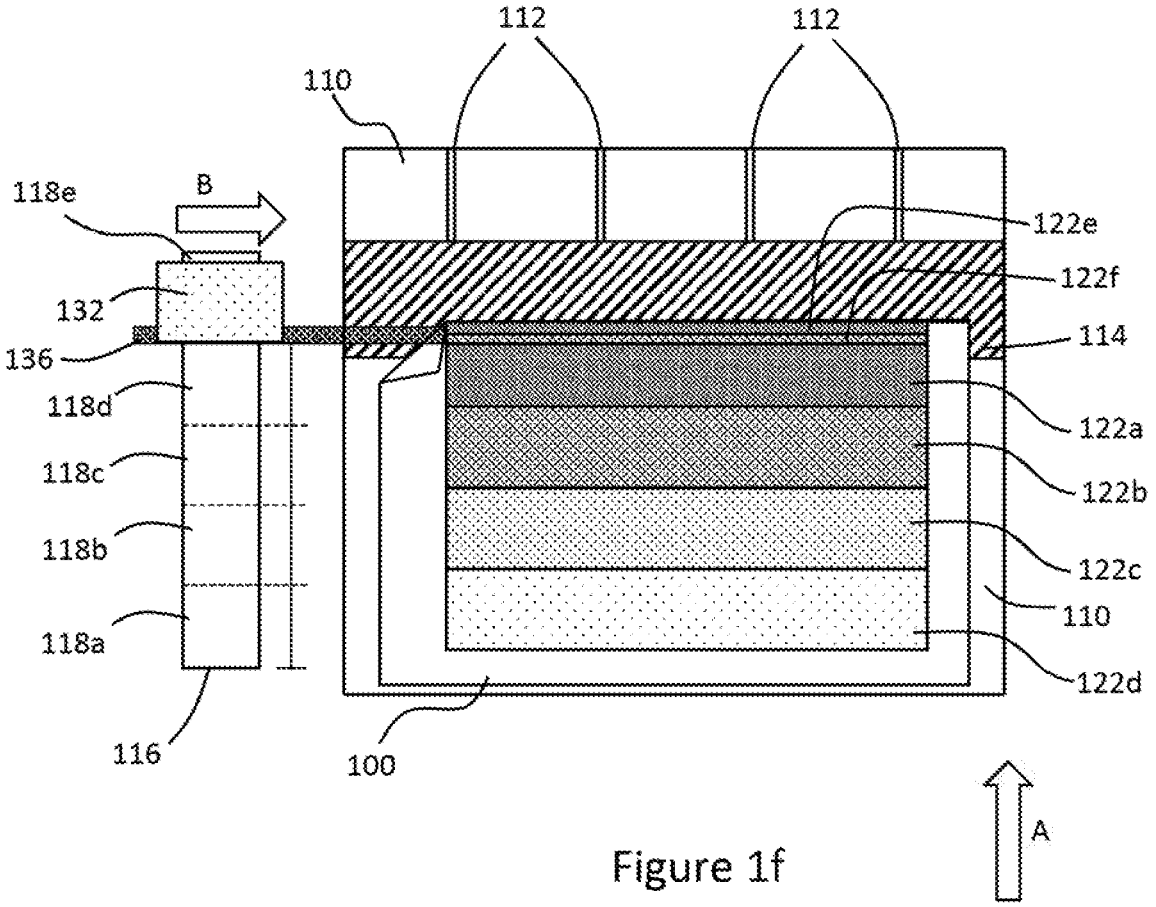

Following the fifth print pass, the substrate may be advanced, in this example, by a distance equal to the advance made following the fourth print pass, such that the substrate is in the position shown in FIG. 1*f*. In some examples, the advance distance may be different to preceding advance distances. Figure if shows the substrate 100 after the substrate has been advanced (following the fifth pass) and after a sixth pass of the print head 116. During the sixth pass, print agent may be delivered onto the substrate within the whole of the margin 120, using nozzles within the subset 132 of nozzles. In this example, nozzles (or rows of nozzles) within a region 136 are used for printing in the margin 120. The nozzles within the region 136, which includes the region 134 shown in FIG. 1*e*, deliver print agent in the pattern 122*e* printed during the fifth print pass, and also into a pattern 122*f*.

Figure 1G:
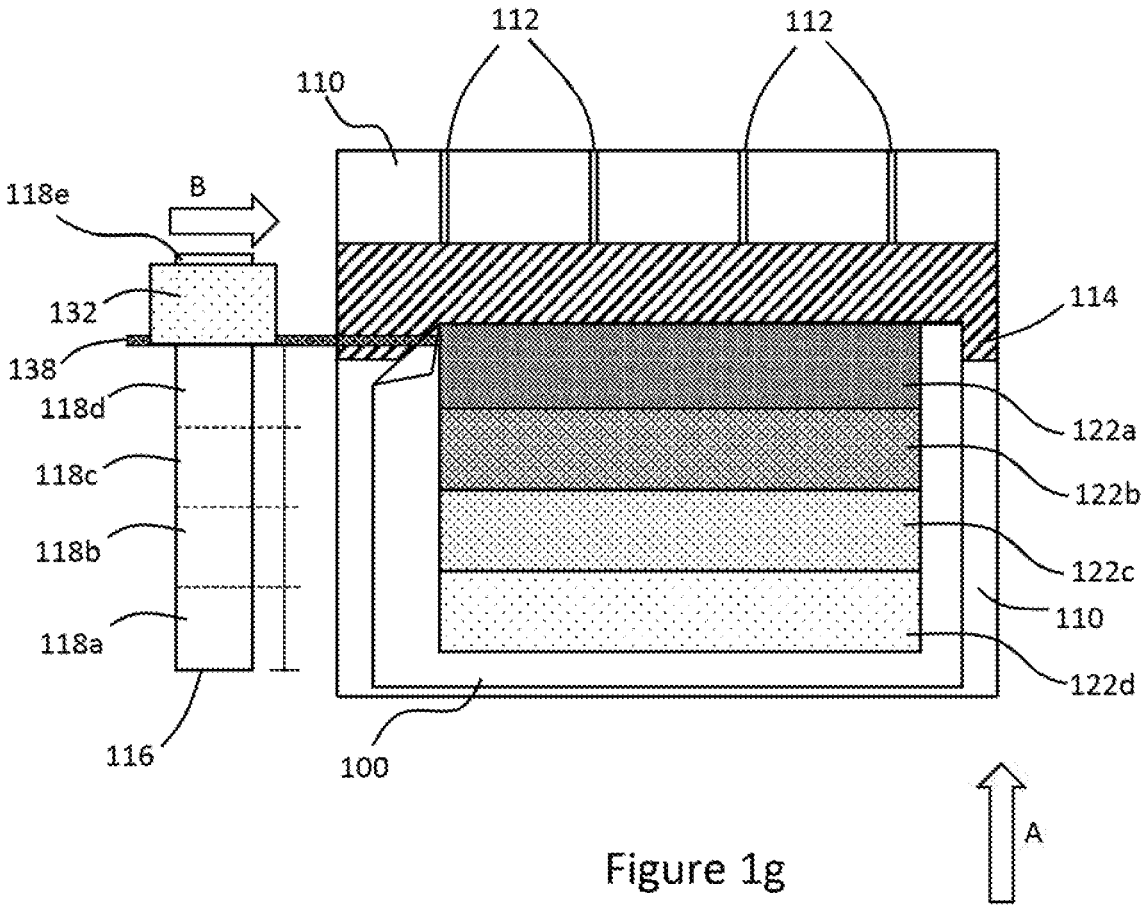

Following the sixth print pass, the substrate, in some examples, may again be advanced by a distance equal to the advance made following the fifth print pass. In some examples, the substrate may not be advanced following the sixth print pass, as the margin 120 is over the absorbent portion 114, and nozzles in the subset 132 are able to print within the margin. FIG. 1*g* shows the substrate 100 after a seventh pass of the print head 116. During the seventh pass, print agent is delivered onto the substrate using nozzles within a region 138 of the subset 132 of nozzles. The nozzles within the region 138 are, in this example, the same nozzles that are in the region 134 (see FIG. 1*e*). The print agent delivered during the seventh print pass completes the delivery of print agent within the margin. Thus, in this example, the margin 120 is printed during three print passes, with two strips (e.g. patterns 122*e*, 122*f*) each receiving two deposits of print agent. In this example, during each print pass to print the margin, print agent may be delivered with 50% of the final intended density, such that the total intended amount of print agent is to be delivered into each strip on the substrate in the margin after two passes. During the print passes in which the margin 120 is printed, nozzles in the bands 118*a-d* are prevented from firing, for example using a print mask.

After the margin has been printed (i.e. after the seventh print pass in this example), nozzles within the subset 132 of nozzles may not be used to deliver print agent again until it is intended to print within another margin of another substrate. Thus, a print mask may applied to prevent nozzles within the subset 132 from delivering print agent, but which allows print agent to be delivered by other nozzles in the print head, such as nozzles within the bands 118*a-d*. Following the seventh print pass, the substrate 100 may be advanced by a distance to bring the patterns 122*b, c, d* into alignment with the bands of nozzles 118*d, c, b* respectively. Thus, the substrate 100 may be advanced by a distance that is shorter than the advance made following the first, second and third print passes. In other words, the substrate advance made following the completion of the printing of the margin 120, in this example, is the same as the advance made following the first, second and third print passes, minus the distance by which the substrate is advanced while printing the margin (i.e. during the fifth, sixth and seventh print passes). Printing of the substrate outside the margin 120 may then continue, with print agent being delivered by nozzles in the bands 118*a-d*.

Figure 1H:
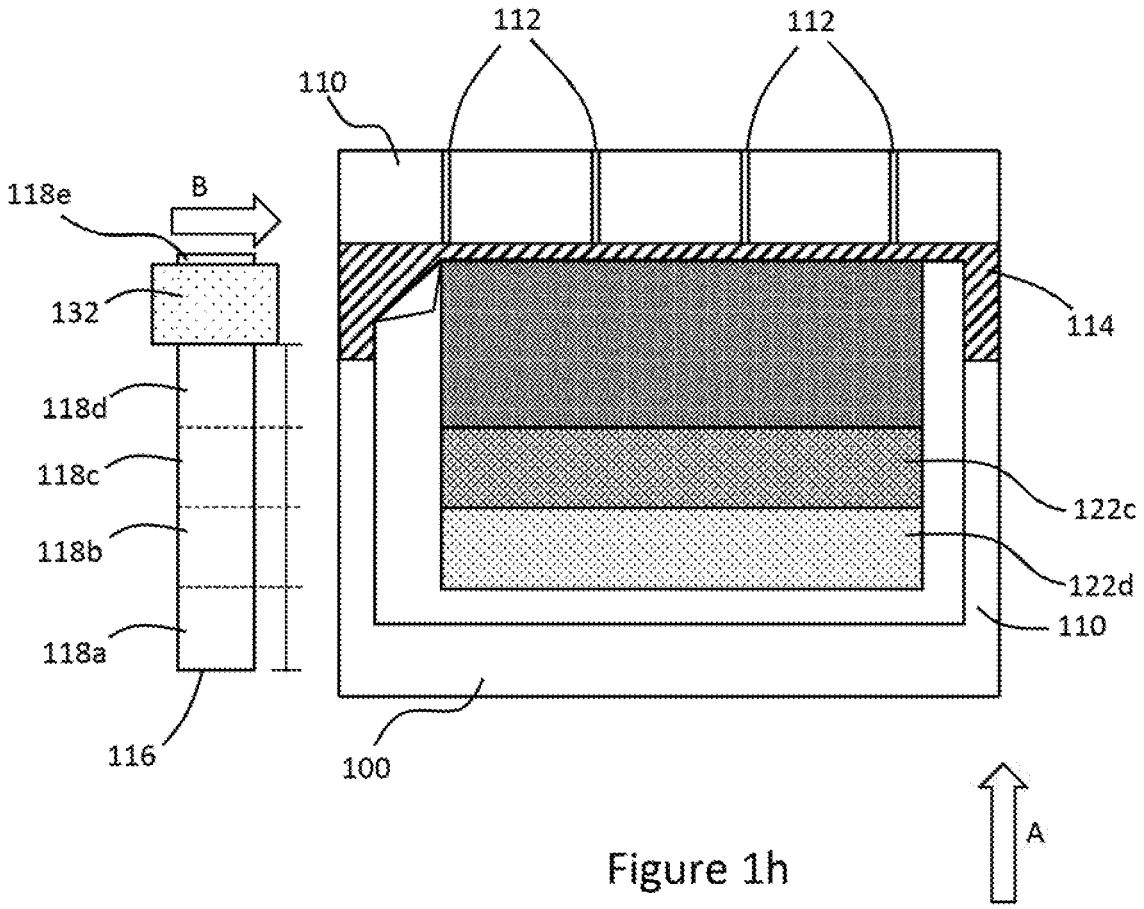

FIG. 1*h* shows the substrate 100 after the substrate has been advanced (following the seventh pass) and after an eighth pass of the print head 116. During the eighth print pass, nozzles in the bands 118*d, c* and *b* deliver print agent onto the substrate 100 in the patterns 122*b, c* and *d* respectively. In this example, following the eighth pass, printing on the substrate in the patterns 122*a* and 122*b* is complete. Printing using the nozzles in the bands 118*a-d* may continue until the intended pattern or image to be printed on the substrate 110 is complete. However, the nozzles within the subset 132 are not used to print outside the margin 120.

As noted above, the example described above with reference to FIG. 1 relates to a print operation which involves four print passes to print a swath outside the margin 120, and three passes to print the region within the margin (i.e. the defined zone) 120. In other examples, however, print operations may involve a smaller or greater number of print passes to complete a swath outside the defined zone and/or within the defined zone and, in some examples, the distance by which the substrate 100 is advanced after each print pass may be relatively smaller than in the example described above. In some examples, the edge 102 of the substrate may be positioned over the absorbent portion 114 for more than three print passes. In such scenarios, print agent may be delivered onto the substrate 100 within the margin 120 during a larger number of print passes, which may result in a relatively higher quality print, as the print agent intended to print in the margin may be divided between additional passes. In some examples, the print agent to be delivered within the margin may be divided evenly between the multiple print passes while, in other examples, the proportion of print agent to be delivered during a print pass of the multiple print passes when printing the margin may be more or less than the proportion of print agent to be delivered during other print passes when printing the margin.

Figure 2:
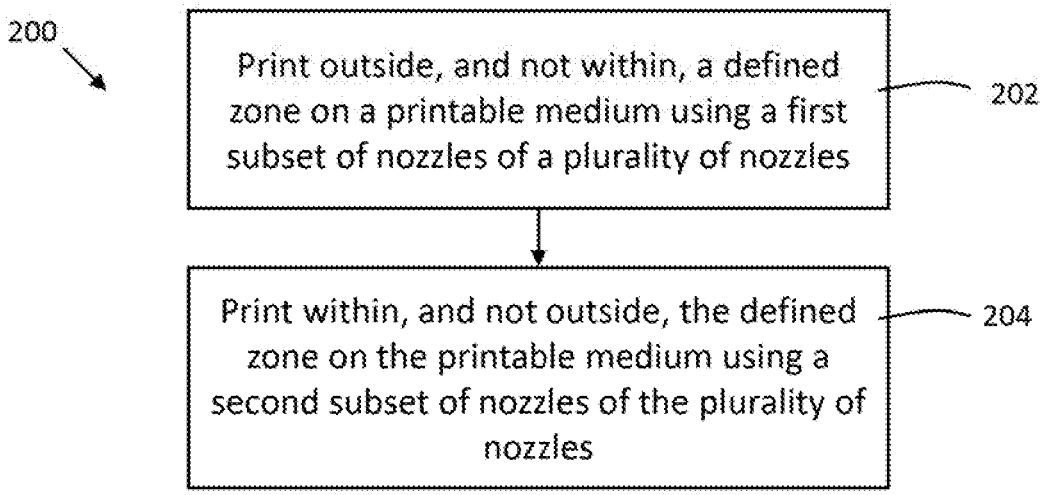
FIG. 2 is a flowchart of an example of a method of printing within a defined zone.

FIG. 2 is a flowchart of an example method 200 of printing on a printable medium. The method of printing may use a print head having a plurality of nozzles. The printable medium may have a leading edge and a defined zone adjacent to the leading edge. The print head may deposit print agent onto the printable medium via the plurality of nozzles during successive printing passes. The method 200 comprises, at block 202, printing outside, and not within, the defined zone on the printable medium using a first subset of nozzles of the plurality of nozzles. The method further comprises, at block 204, printing within, and not outside, the defined zone on the printable medium using a second subset of nozzles of the plurality of nozzles. Thus, as in the example described above, nozzles in the first subset of nozzles (e.g. the subset 132 in FIG. 1) may not be used to deliver print agent until the printable medium, or substrate, is in a particular position relative to a print bed of the print apparatus to which the print belongs. When printing a borderless print job on a printable medium (e.g. printing onto a printable medium which is to be printed up to the leading edge, nozzles in the first subset (e.g. the subset 132 of FIG. 1) are used just to print within a defined zone adjacent to the leading edge (e.g. within the margin). Nozzles in a second subset of the print head (e.g. nozzles not within the subset 132 of FIG. 1) may be used to print just outside the defined zone, and may not be used to print within the defined zone.

In some examples, the nozzles included within the first subset of nozzles are not included within the second subset of nozzles. In other words, the nozzles of the print head may be divided (e.g. by a mask) into two distinct or discrete sets of nozzles; a first set to print within the margin of a substrate and a second set to print outside the margin.

As explained in the example described above with reference to FIG. 1, the first subset of nozzles may print outside the defined zone on the printable medium during a first printing pass, and the second subset of nozzles may print within the defined zone on the printable medium during a second printing pass, after the first printing pass. Thus, some printing may be performed on the printable medium outside the margin before the margin is printed. Following the printing of the margin, in some examples, the first subset of nozzles may print outside the defined zone on the printable medium during a third printing pass, after the second printing pass.

In some examples, the second subset of nozzles may print within the defined zone on the printable medium when the leading edge of the printable medium is within a defined area. The defined area may, for example, be an area above a print agent-absorbing portion, such as absorbent foam 114. The second subset of nozzles may be prevented from printing within the defined zone on the printable medium when the leading edge of the printable medium is outside the defined area (e.g. not in an area above the print agent-absorbing portion). In this way, print agent is less likely to be inadvertently deposited onto a platen of the print apparatus.

Figure 3:
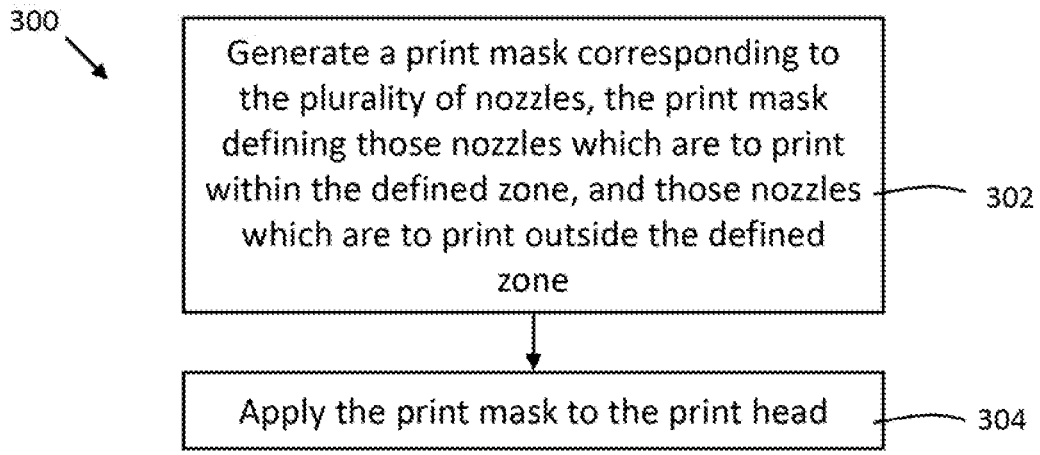
FIG. 3 is a flowchart of a further example of a method of printing within a defined zone.

FIG. 3 is a flowchart of an example method 300 of printing on a printable medium. The method 300 may include blocks 202 and 204 discussed above. The method 300 may further comprise, at block 302, generating a print mask corresponding to the plurality of nozzles, the print mask defining those nozzles which are to print within the defined zone, and those nozzles which are to print outside the defined zone. In some examples, the method 300 may comprise generating multiple print masks, for example a first print mask defining those nozzles which are to print within the defined zone (e.g. a border mask), and a second print mask defining those nozzles which are to print outside the defined zone (e.g. a regular printing mask). The print mask may, in some examples, be a virtual print mask. The print mask may be generated in the form of computer code. In the some examples, the print mask may be generated by a processor, or processing circuitry associated with the print apparatus. At block 304, the method 300 may comprise applying the print mask to the print head. The print mask may be generated based on print job data defining the print job to be performed. In some examples the print mask may be generated prior to any print agent having been deposited from the print head.

Figure 4:
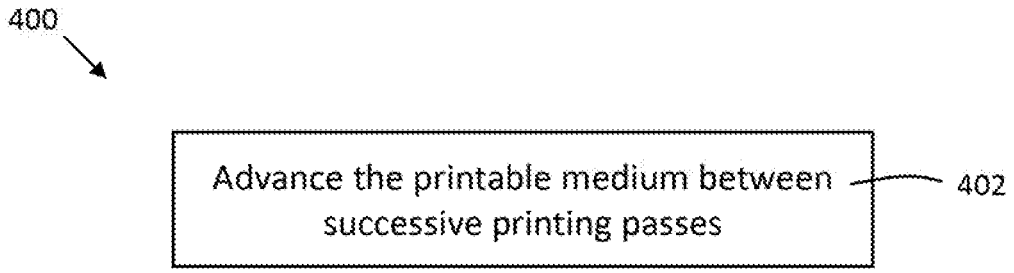
FIG. 4 is a flowchart of a further example of a method of printing within a defined zone.

FIG. 4 is a flowchart of an example method 400 of printing on a printable medium. The method 400 may include any of blocks 202, 204, 302 and 304 discussed above. At block 402, the method 400 may comprise advancing the printable medium between successive printing passes. For example, once a printing pass has been completed, a substrate advancer of the print apparatus may move the printable medium along a path so that subsequent printing passes may be performed. In some examples, between printing passes in which the first subset of nozzles are to print, the printable medium may be advanced by a first defined distance, and between printing passes in which the second subset of nozzles are to print, the printable medium may be advanced by a second defined distance, different from the first defined distance. In other words, the number of nozzles (or rows of nozzles) used to print outside the defined zone on the printable medium during a printing pass may be different to the number of nozzles (or rows of nozzles) used to print within the defined zone during a printing pass. Thus, a different number of printing passes may be used to print a swath that forms the margin than the number of printing passes used to print a swath outside the margin.

During each printing pass while printing within the defined zone, the second subset of nozzles may, in some example, print with a print quality equivalent to the quality of printing performed by the first subset of nozzles during each printing pass while printing outside the defined zone. Thus, the print quality of the image printed within the defined zone may be the same as (or indistinguishable from) the print quality of the image printed outside the defined zone. To achieve this, a density of print agent deposited within the defined zone may be the same as the density of print agent deposited outside the defined zone, for example.

Figure 5:
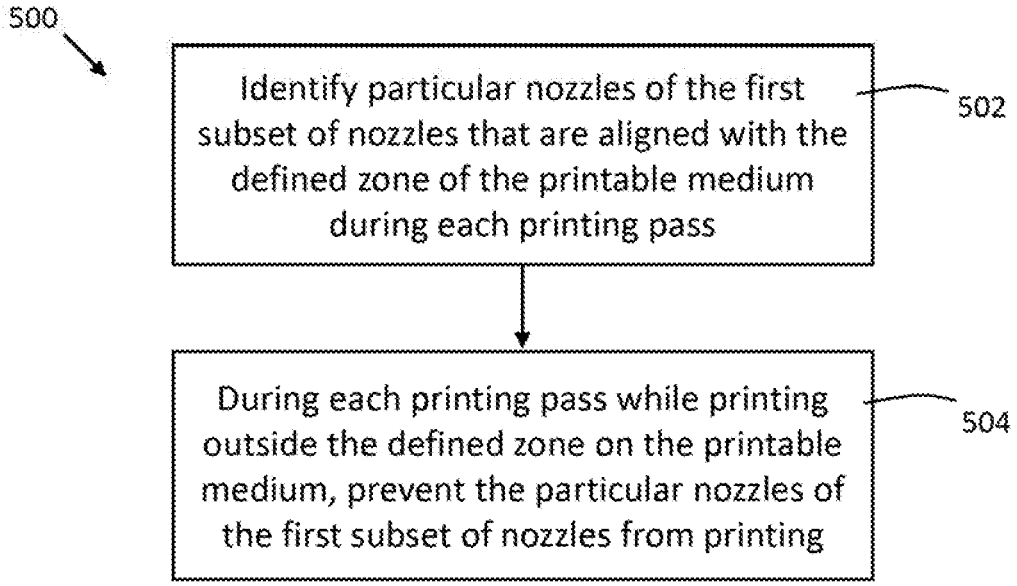
FIG. 5 is a flowchart of a further example of a method of printing within a defined zone.

FIG. 5 is a flowchart of an example method 500 of printing on a printable medium. The method 500 may include any of the blocks discussed above with reference to FIGS. 2 to 4. The method may comprise, at block 502, identifying particular nozzles of the first subset of nozzles that are aligned with the defined zone of the printable medium during each printing pass. At block 504, the method 500 may comprise, during each printing pass while printing outside the defined zone on the printable medium, preventing the particular nozzles of the first subset of nozzles from printing. Thus, even though nozzles within the first subset of nozzles are able to print outside the defined zone, some nozzles within the first subset may be prevented from printing if they are aligned with the leading edge of the printable medium, or with the defined zone. Such nozzles are included in the region 124 of FIG. 1*a*.

Preventing the particular nozzles from printing (block 504) may, in some examples, comprise applying a print mask to the print head, the print mask defining the particular nozzles of the first subset of nozzles which are not to print. As with the print mask or masks used to define which nozzles fall within the first subset and which nozzles fall within the second subset, the print mask used to define the particular nozzles of the first subset of nozzles which are not to print may be a virtual mask, generated using computer code, for example.

Figure 6:
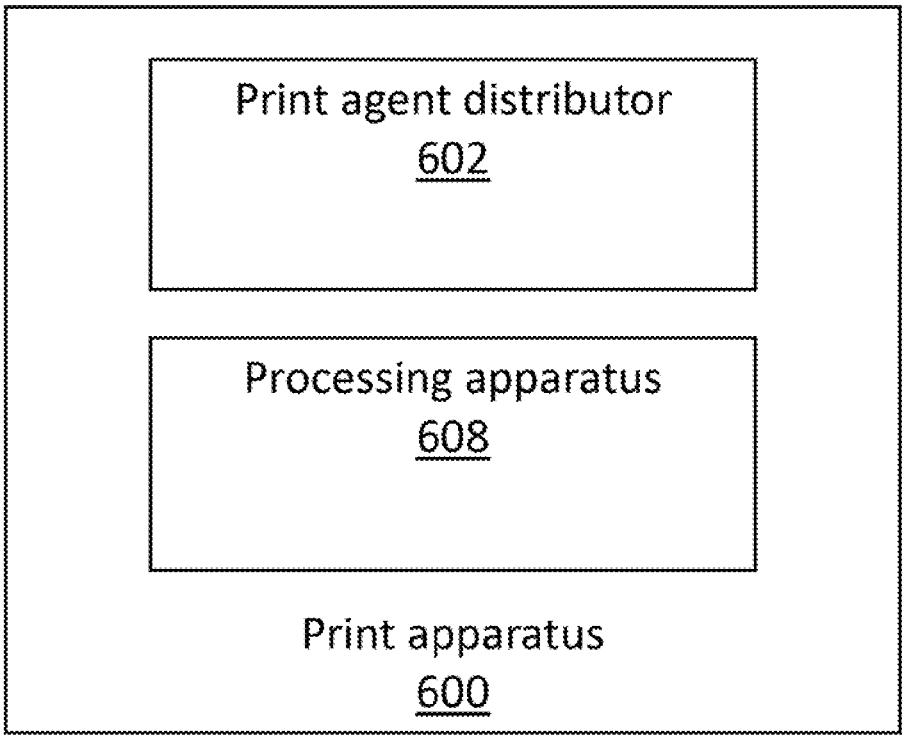
FIG. 6 is a schematic of an example of a print apparatus.

The method disclosed above may be performed by an apparatus, such as a print apparatus. FIG. 6 is a schematic showing an example of a portion of a print apparatus 600 for printing in defined zones. The print apparatus 600 may comprise a print agent distributor 602 having a plurality of nozzles to deposit print agent onto a substrate during successive printing passes. In some examples, the substrate may have a leading edge and a defined zone adjacent to the leading edge. The print apparatus 600 may also comprise processing apparatus 604. The processing apparatus 604 may be operably coupled to, and/or may control, the print agent distributor 602. The processing apparatus 604 may enable a first subset of nozzles of the plurality of nozzles to deposit print agent outside, and not within, a defined zone on the substrate. The processing apparatus 604 may enable a second subset of nozzles of the plurality of nozzles to deposit print agent within, and not outside, the defined zone on the substrate. The print apparatus 600 may comprise, or be similar to, the print apparatus discussed with reference to FIG. 1.

Figure 7:
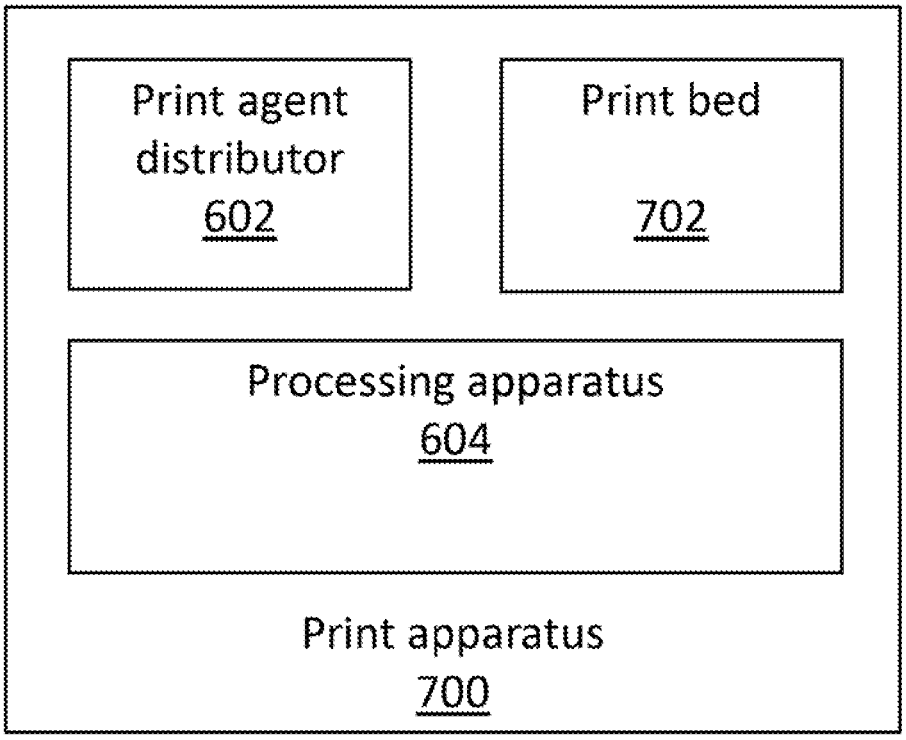
FIG. 7 is a schematic of a further example of a print apparatus.

FIG. 7 is a schematic showing an example of a portion of a print apparatus 700 for printing in defined zones. The print apparatus 700 may comprise the print agent distributor 602 and the processing apparatus 604. The print apparatus 700 may comprise a print bed 702 having a platen to support the substrate, and a print agent-absorbing element, such as the absorbent portion 114. The processing apparatus 604 may enable the second subset of nozzles to deposit print agent within the defined zone on the substrate when the defined zone is over the print agent-absorbing element. The processing apparatus 604 may, for example, generate a print mask to prevent the second subset of nozzles from depositing print agent within the defined zone unless the defined zone is over (i.e. above) the print agent-absorbing element.

Figure 8:
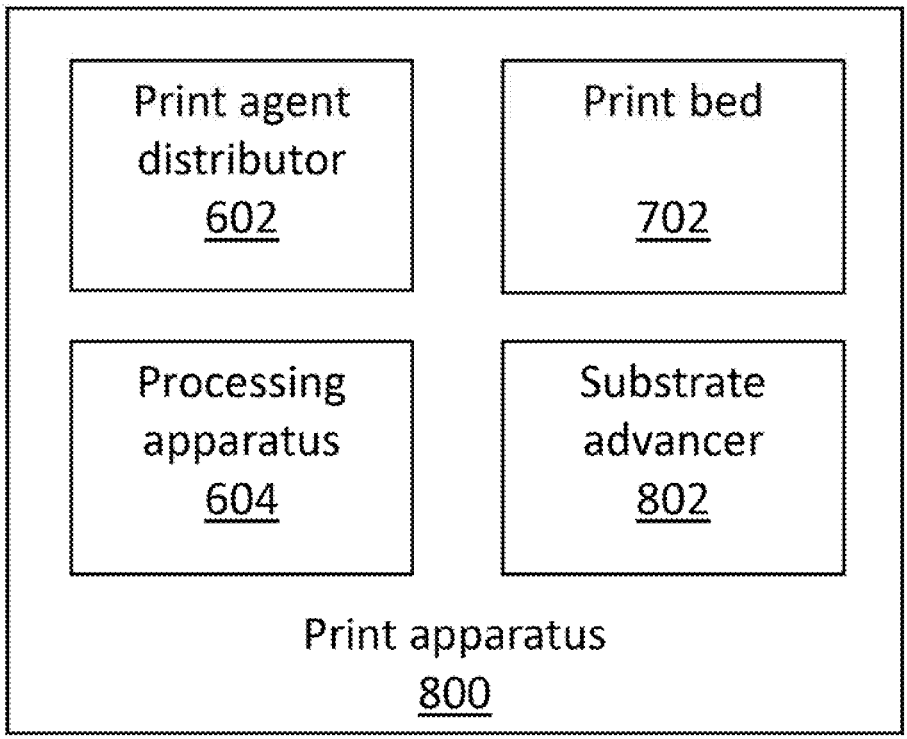
FIG. 8 is a schematic of a further example of a print apparatus.

FIG. 8 is a schematic showing an example of a portion of a print apparatus 800 for printing in defined zones. The print apparatus 800 comprises the print agent distributor 602, and may comprise the processing apparatus 604 and/or the print bed 702. The print apparatus 800 may comprise a substrate advancer 802 to advance the substrate between successive printing passes of the print agent distributor 602. Between print passes in which the first subset of nozzles are to print, the substrate advancer 802 may advance the substrate by a first defined distance. Between print passes in which the second subset of nozzles are to print, the substrate advancer 802 may advance the substrate by a second defined distance, different from the first defined distance. In some examples, the processing apparatus 604 may be operably coupled to the substrate advancer 802, and may cause the substrate the substrate advancer to advance (i.e. move) the substrate by a defined distance based on the print job data and/or on the nature of the print head (e.g. the number of nozzles).

Figure 9:
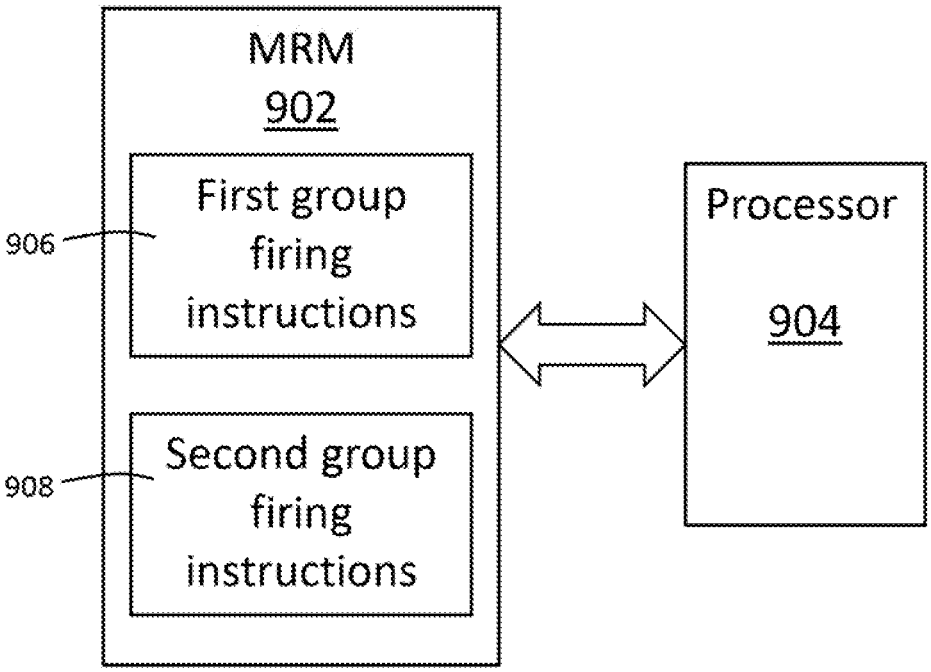
FIG. 9 is a schematic of an example machine-readable medium with a processor to perform a method of printing within a defined zone.

FIG. 9 shows, schematically, a machine-readable medium 902 associated with a processor 904. The machine-readable medium 902 comprises instructions which, when executed by the processor 904, cause the processor 904 to cause a first group of nozzles of a print head to deposit print agent outside, and not within, a defined area on a printable medium. In some examples, the first group of nozzles may be caused to deposit print agent by 'first group' firing instructions 906 contained within the machine-readable medium 902.

The machine-readable medium 902 may comprise instructions which, when executed by the processor 904, cause the processor 904 to cause a second group of nozzles of the print head to deposit print agent within, and not outside, the defined area on the printable medium. In some examples, the second group of nozzles may be caused to deposit print agent by 'second group' firing instructions 908 contained within the machine-readable medium 902.

In some examples, the machine-readable medium 902 may comprise instructions which, when executed by the processor 904, cause the processor 904 to create a first print mask corresponding to the first group of nozzles, and defining those nozzles which are to print outside the defined zone. The machine-readable medium 902 may, in some examples, comprise instructions which, when executed by the processor 904, cause the processor 904 to create a second print mask corresponding to the second group of nozzles, and defining those nozzles which are to print within the defined zone. In some examples, the machine-readable medium 902 may include print mask creation instructions (not shown).

The machine-readable medium 902 may, in some examples, comprise instructions which, when executed by the processor 904, cause the processor 904 to identify particular nozzles of the first group of nozzles that are aligned with the defined area of the printable medium. In other words, an identification may be made of those nozzles which are aligned with the defined area of the printable medium (which may include the leading edge of the medium), and which are not to deliver print agent (since the defined area is not above a particular region (e.g. the absorbent portion)). The machine-readable medium 902 may, in some examples, comprise instructions which, when executed by the processor 904, cause the processor 904 to create a third print mask corresponding to the particular nozzles of the first group of nozzles, the third print mask to prevent the particular nozzles from delivering print agent while the first group of nozzles is caused to deposit print agent.

Examples in the present disclosure can be provided as methods, systems or machine readable instructions, such as any combination of computer code, hardware or the like. Such machine readable instructions may be included on a computer readable storage medium (including but is not limited to disc storage, CD-ROM, optical storage, etc.) having computer readable program codes therein or thereon.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that each flow and/or block in the flow charts and/or block diagrams, as well as combinations of the flows and/or diagrams in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit. ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer programme product, the computer programme product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A method of printing on a printable medium using a print head having a plurality of nozzles, the printable medium having a leading edge and a defined zone adjacent to the leading edge, wherein the print head is to deposit print agent onto the printable medium via the plurality of nozzles during successive printing passes, the method comprising:

printing outside, and not within, the defined zone on the printable medium using the plurality of nozzles prior to printing within, and not outside, the defined zone when the defined zone is not positioned over a print agent-absorbing element;

advancing the printable medium so that the defined zone is positioned over the print agent-absorbing element; and subsequently printing within, and not outside, the defined zone on the printable medium using the plurality of nozzles when the defined zone is positioned over the print agent-absorbing element.

2. A method according to claim 1, wherein a first subset of nozzles of the plurality of nozzles prints outside, and not within the defined zone, a second subset of nozzles of the plurality of nozzles prints within, and not outside, the defined zone, and nozzles included within the first subset of nozzles are not included within the second subset of nozzles.

3. A method according to claim 2, wherein the first subset of nozzles are to print outside the defined zone on the printable medium during a first printing pass, and the second subset of nozzles are to print within the defined zone on the printable medium during a second printing pass, after the first printing pass.

4. A method according to claim 2, further comprising:

advancing the printable medium between successive printing passes;

wherein, between printing passes in which the first subset of nozzles are to print, the printable medium is advanced by a first defined distance, and between printing passes in which the second subset of nozzles are to print, the printable medium is advanced by a second defined distance, different from the first defined distance.

5. A method according to claim 2, wherein, during each printing pass while printing within the defined zone, the second subset of nozzles are to print with a print quality equivalent to the quality of printing performed by the first subset of nozzles during each printing pass while printing outside the defined zone.

6. A method according to claim 2, further comprising:

identifying particular nozzles of the first subset of nozzles that are aligned with the defined zone of the printable medium during each printing pass; and during each printing pass while printing outside the defined zone on the printable medium, preventing the particular nozzles of the first subset of nozzles from printing.

7. A method according to claim 6, wherein preventing the particular nozzles from printing comprises applying a print mask to the print head, the print mask defining the particular nozzles of the first subset of nozzles which are not to print.

8. A method according to claim 1, further comprising:

generating a print mask corresponding to the plurality of nozzles, the print mask defining nozzles which are to print within the defined zone, and nozzles which are to print outside the defined zone; and applying the print mask to the print head.

9. Print apparatus, comprising:

a print agent distributor having a plurality of nozzles to deposit print agent onto a substrate during successive printing passes;

a print bed having a platen to support the substrate, and a print agent-absorbing element;

a substrate advancer to advance the substrate between successive printing passes of the print agent distributor; and processing apparatus to:

enable the plurality of nozzles to deposit print agent outside, and not within, a defined zone on the substrate adjacent to a leading edge when the defined zone is not positioned over the print agent-absorbing element in a first printing pass of the print agent distributor;

subsequently enable the substrate advancer to advance the substrate so that the defined zone is positioned over the print agent-absorbing element; and subsequently enable the plurality of nozzles to deposit print agent within, and not outside, the defined zone on the substrate when the defined zone is positioned over the print agent-absorbing element.

10. A machine-readable medium comprising instructions which, when executed by a processor, cause the processor to:

cause a first group of nozzles of a print head to deposit print agent outside, and not within, a defined area on a printable medium adjacent to a leading edge of the printable medium; and cause a second group of nozzles of the print head to deposit print agent within, and not outside, the defined area on the printable medium, wherein the leading edge of the printable medium is advanced past the first group before being advanced past the second group, and wherein just the second group ever prints within the defined area, such that the first group never prints within the defined zone.

11. A machine-readable medium according to claim 10, comprising instructions which, when executed by a processor, cause the processor to:

create a first print mask corresponding to the first group of nozzles, and defining those nozzles which are to print outside the defined zone; and create a second print mask corresponding to the second group of nozzles, and defining those nozzles which are to print within the defined zone.

12. A machine-readable medium according to claim 10, comprising instructions which, when executed by a processor, cause the processor to:

identify particular nozzles of the first group of nozzles that are aligned with the defined area of the printable medium; and create a third print mask corresponding to the particular nozzles of the first group of nozzles, the third print mask to prevent the particular nozzles from delivering print agent while the first group of nozzles is caused to deposit print agent.

* * * * *